US005615765A

United States Patent [19]

Roericht

[11] Patent Number: 5,615,765

[45] Date of Patent: Apr. 1, 1997

[54] CONTAINER FOR THE RECEPTION OF OBJECTS

[76] Inventor: Hans Roericht, Am Hochstraess 8/24, 89081 Ulm, Germany

[21] Appl. No.: 530,225

[22] PCT Filed: Mar. 26, 1994

[86] PCT No.: PCT/DE94/00352

§ 371 Date: Oct. 2, 1995

§ 102(e) Date: Oct. 2, 1995

[87] PCT Pub. No.: WO94/22342

PCT Pub. Date: Oct. 13, 1994

[30] Foreign Application Priority Data

Apr. 5, 1993 [DE] Germany ..... 43 11 222.6

[51] Int. Cl.[6] ..... B65D 43/16

[52] U.S. Cl. ..... 206/45.23; 206/6; 220/4.22; 220/212; 220/339

[58] Field of Search ..... 206/5, 6, 45.23; 220/4.22, 4.23, 212, 339, 375

[56] References Cited

U.S. PATENT DOCUMENTS

| | | | |
|---|---|---|---|
| 991,323 | 5/1911 | Kirby | 206/6 |
| 2,219,524 | 8/1940 | Lindley | 16/150 |

FOREIGN PATENT DOCUMENTS

| | | |
|---|---|---|
| 165425 | 2/1950 | Austria . |
| 2161213 | 7/1973 | France . |
| 3635959 | 5/1988 | Germany . |
| 4114315 | 11/1991 | Germany . |
| 2189290 | 10/1987 | United Kingdom . |

*Primary Examiner*—Jimmy G. Foster
*Attorney, Agent, or Firm*—Spencer & Frank

[57] ABSTRACT

A container for the reception of objects, and especially a spectacles case, is proposed, having two mutually opposing, circular-segment-shaped half-shells for the creation of a hollow body. In order to enlarge the angle of opening between the half-shells, these are joined together by a cross-strapped joint.

20 Claims, 5 Drawing Sheets

CONTAINER FOR THE RECEPTION OF OBJECTS

BACKGROUND OF THE INVENTION

The invention relates to a container for the reception of objects, especially a spectacles case, that includes two mutually-opposing half-shells joined together by a joint.

Containers, for example for use as a spectacles case, have become known in the form of half-shells which can be folded together and which exhibit, on a longitudinal abutting edge of the half-shells lying one on top of the other, a conventional hinge. The half-shells or even just a cover on a half-shell can thereby be tilted open and can be opened, by pivoting for example, generally from 90° to 180°. The hinge connection consequently connects a longitudinal edge of the two parts forming the container.

The connections, for example, between two half-shells solely enable the container to be opened and closed by means of a connecting edge and allow only a limited angle of opening for the structure.

SUMMARY OF THE INVENTION

The object of the invention is to provide a container for the reception of objects, and especially a spectacles case, which container likewise comprises two half-shells which can be folded together but exhibits, in its motional facilities and hence in its handling, greater play than traditional containers.

This object is achieved, based upon a container of the type described by way of introduction, by providing first and second mutually-opposing half-shells that are positionable relative to one another to form a hollow body when the container is closed. Each half-shell has first and second opposing, longitudinally extending edges. The first edges abut against each other and the second edges abut against each other when the half-shells are positioned to form the hollow body. At least first, second and third joint straps are arranged sequentially in the longitudinal direction and extend transverse to the longitudinal direction and in an arcuate path over an outer surface of the respective half-shells to join the half-shells together. The first and second joint straps each has a first end fastened to the first edge of the first half-shell, and a second end fastened to the second edge of the second half-shell. The third joint strap has a first end fastened to the first edge of the second half-shell, and a second end fastened to the second edge of the first half-shell. The joint straps allow the outer surfaces of the half-shells to roll upon one another when the container is open.

The invention is based upon the core concept of providing a container which, in its hinge connection, is not limited to the usual extent. Rather, the particular shaping of the container housing in the form, in particular, of cylindrical, circular-segment-shaped or otherwise three-dimensionally shaped half-shells allows these three-dimensional half-shells an opportunity to roll one upon the other, the tight connection between the half-shells being guaranteed by a special cross-strapped joint. Such an arrangement has the advantage that the half-shells can be rolled one upon the other in such a way that a pivotal motion through more than 180° is enabled. The half-shells can consequently form both a closed container and an outwardly open, shell-shaped container, the latter being able to be used, for example, for the attractive presentation of objects.

The interconnection of the three-dimensional half-shells is realized by means of a cross-strapped joint, which is known per se, having straps ring crosswise over the arc-shaped outer faces of the half-shells. The straps can herein respectively be disposed in pairs in the two lateral end regions of the container or, in space covering arrangement, over the entire outer surface of the container.

In the closed state of the container, there can be provided on its abutting surfaces means for preventing the half-shells from being inadvertently opened.

BRIEF DESCRIPTION OF THE DRAWINGS

Further details and advantages of the invention are explained in greater detail in the following description of an illustrative embodiment and are represented in the drawings, in which:

FIG. 3*a*–3*e* show a section along the sectional line A in FIG. 2, exhibiting the sequence of motions a) to e), FIG. 4*a*–4*e* show a section along the interface B in FIG. 2, exhibiting the sequence of motions a) to e)

DETAILED DESCRIPTION OF THE INVENTION

Figure 10:
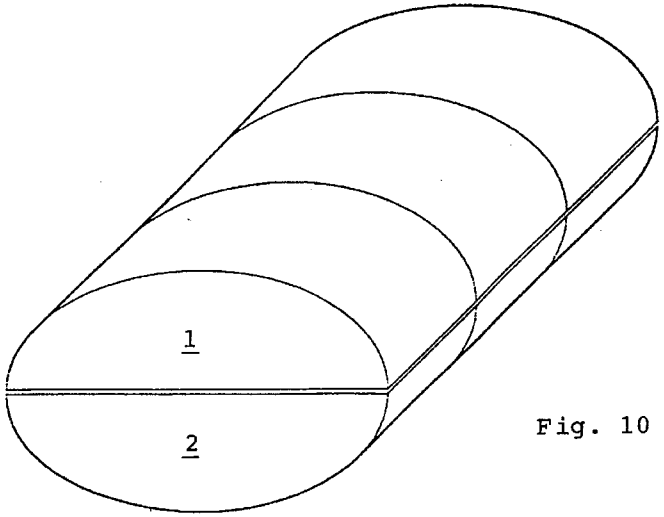
FIGS. 8–11 show various alternative shapes of the half-shells.
Figure 11:
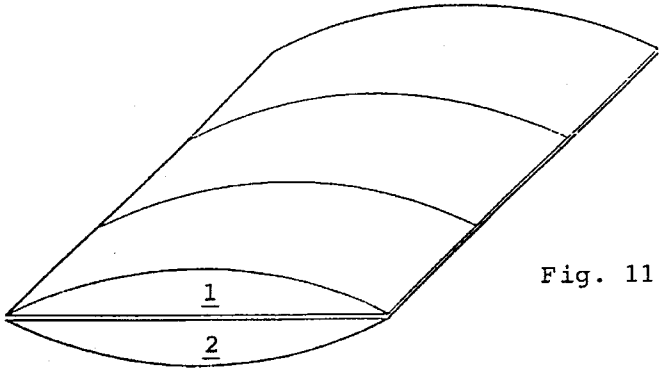
Figure 8:
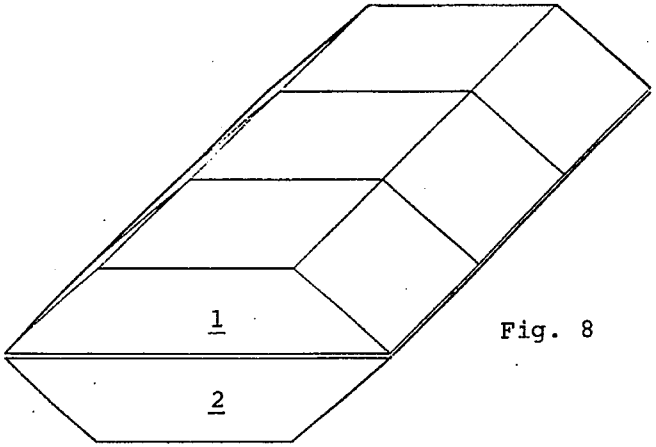
Figure 9:
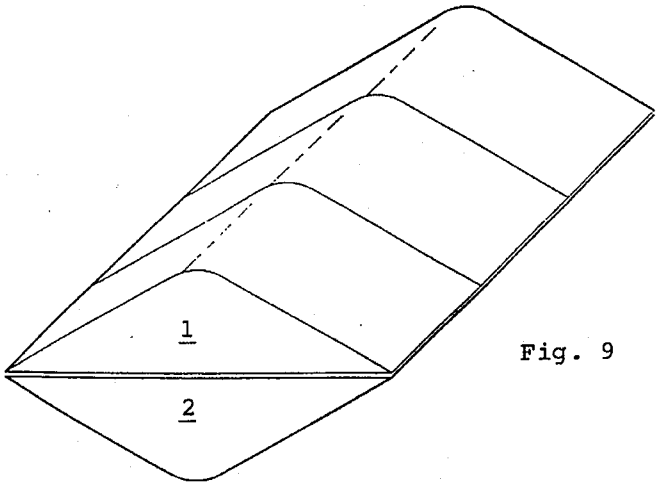

FIG. 1 shows, by means of the individual figures a) to f), a sequence of motions of a container represented, for example, as a spectacles case. The container comprises two half-shells 1, 2, which exhibit a circular-segment-shaped cross-section or a semicircular cross-section. The half-shells 1, 2 are respectively, in the illustrative embodiment, of equal-sized configuration. The half-shells can also however exhibit a different cross-section, e.g. a triangular or rectangular cross-section or the like. In particular, the cross-sectional profile can be arcuate-shaped, such as shown in FIGS. 10 and 11, or triangular- or parallelogram-shaped, such as shown in FIGS. 8 and 9.

The lateral front sides of each half-shell 1, 2 are closed off by matched, circular-segment-shaped wall sections 3, 4 for the half-shell 1, or 3', 4' for the half-shell 2. The half-shells 1, 2 are joined together by a cross-strapped joint, to be more closely described in FIGS. 3 and 4, such that the sequence of motions represented in FIG. 1 can be realized in the part-figures a) to f) by virtue of a rotary motion through more than 180°. The upper half-shell 1, which is configured as a container cover, herein opens in FIG. 1*a*) at the front opening edge or abutting edge 5, the rear abutting edge 6 acting, up to an angle of opening of $\alpha_1$=180°, as a fixed longitudinal axis 7 of the hinge (see FIG. 1*b*)). This circular motion about the rotational axis 7 is represented in FIG. 1*b*) by the arrow 8.

Figures 1A, 1B, 1C, 1D, 1E, 1F:
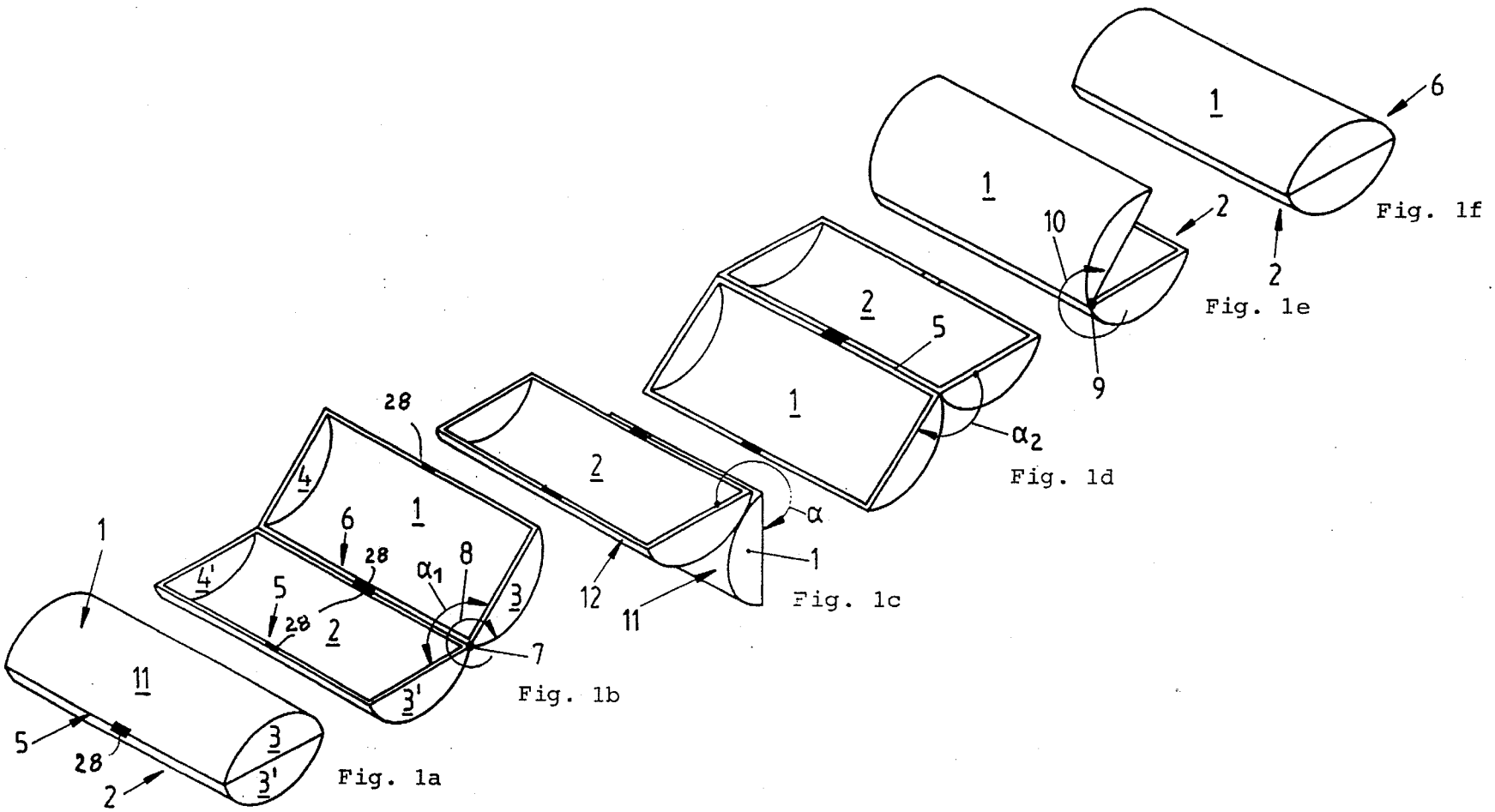
FIGS. 1*a*–1*f* show a diagrammatic representation of a container, e.g. configured as a spectacles case, in various motional settings.

If the Upper half-shell 1 as represented in FIG. 1*c*) moves over an angle of opening $\alpha>180°$, then the longitudinal axis 7 of the hinge becomes ineffective as a rotational axis and the two half-shells 1, 2 roll one upon the other on their arc-shaped, cylindrical or facet-like contacting surfaces 11, 12. This rolling operation is represented in FIG. 1*c*) to 1*d*). This rolling motion extends from a first straight-line position ($\alpha_1=180°$) over an angle of rotation of $\alpha_2=180°$ until the half-shell 1 comes to lie on the opposite side in a straight line next to the half-shell 2. From this motional state, the front abutting edge 5 acts as a stationary longitudinal axis 9 of the hinge, so that the half-shell 1 further rotates in the clockwise direction, in the arrow direction 10, about this fixed hinge axis 9. This further sequence of motions is represented in FIG. 1*e*). The closed state of the half-shells 1, 2 lying one on top of the other is shown by FIG. 1*f*), in which position, following realization of a rotary motion through $\alpha=540°$, the rear abutting edge 6 constitutes the opening edge.

Figure 2:
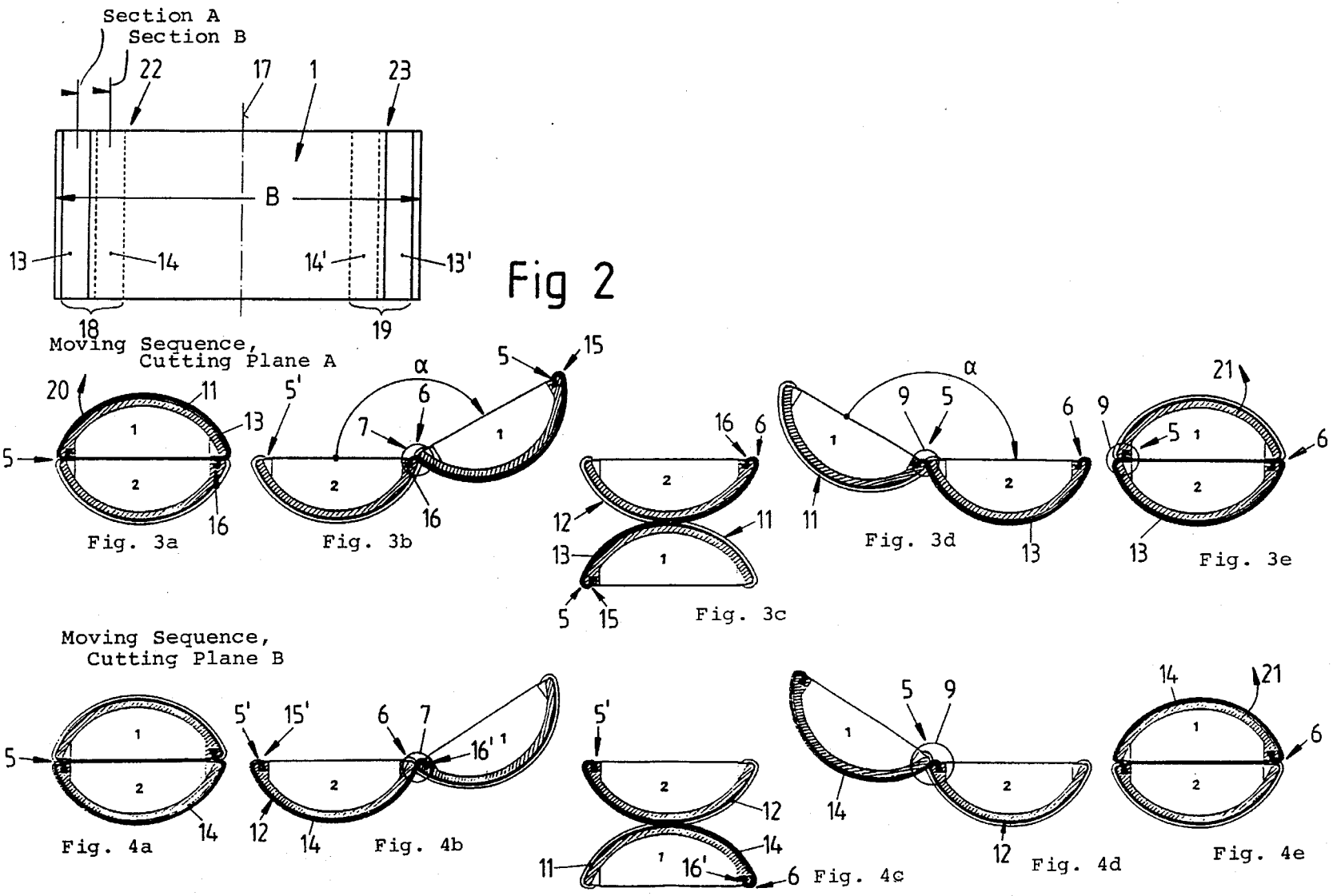
FIG. 2 shows a top view of an upper half-shell with underlying half-shell in the folded-together state, having a lateral joint strap arrangement.

For the realization of this pivotal motion, cross-strapped joints are used, as is represented in greater detail in FIGS. 2 to 4.

The cross-strapped joints 18, 19, which are represented in FIGS. 2 to 4 and explained in greater detail below, have become known, in principle, from totally different specialist fields. Thus reference is made, for example, to DE 41 14 315 A1 of the applicant, in which a hinge connection for an articulated connection of surface elements is described. The basic principle of this connection by means of a cross-strapped joint is also known from AT-Patent Specification 165 425 or from GB 2 189 290 A. Reference is expressly made to this prior art for the production and creation of cross-strapped joints. The basic principle of these cross-strapped joints is, in particular, to cause arc-shaped surfaces to roll and revolve one upon the other and to join together diametrically opposing arc ends by means of flexible hinge straps arranged in pairs.

The laterally outer, upper joint strap 13 of the upper half-shell 1, which joint strap is represented in FIG. 2 in top view and in FIG. 3*a* in side view along the sectional line A in FIG. 2, is tightly connected at the front opening edge 5 of this upper half-shell 1 to this abutting edge region, by U-shaped envelopment and embedment in a fastening groove 16. In FIG. 3*b*), the U-shaped embracing and embedment of the hinge strap 13 in the abutting edge 5 is represented by the reference symbol 15.

The upper joint strap 13, in the sequence of motions corresponding to the representation according to FIGS. 3*a*), 3*b*), runs from the fastening point 15, via the outer, arc-shaped contacting surface 11, to the opposite rear abutting edge 6 and is there embedded in the lower half-shell 2 in a corresponding fastening groove 16. In order to hold the half-shells 1, 2 tightly together even during the rolling motion, in accordance with the representation in FIGS. 3*c*), 4*c*), the joint strap 13 is assigned a further joint strap 14 which runs cruciformly thereto and the course of which is shown in the section B according to FIG. 2 and in the sequence of motions according to FIG. 4. This joint strap 14 is fastened in the region of the front opening edge 5, in the lower half-shell (edge region 5'), likewise in a U-shaped embedment 15' and runs over the arc-shaped, lower contacting surface 12 of the lower half-shell 2 to the rear abutting edge 6 and is fastened there, in the upper half-shell 1, in a corresponding fastening groove 16'.

Figure 7A:
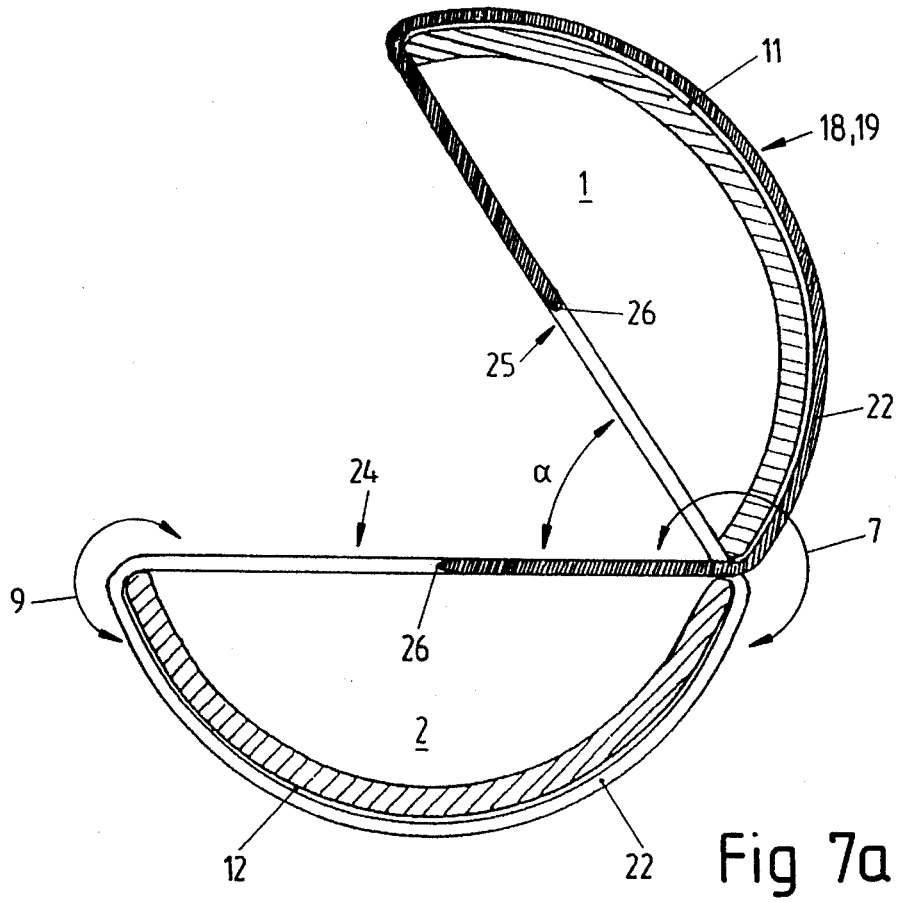
FIG. 7*a*–7*b* show a further illustrative embodiment of the container, exhibiting a continuous cross strapped joint.
Figure 7B:
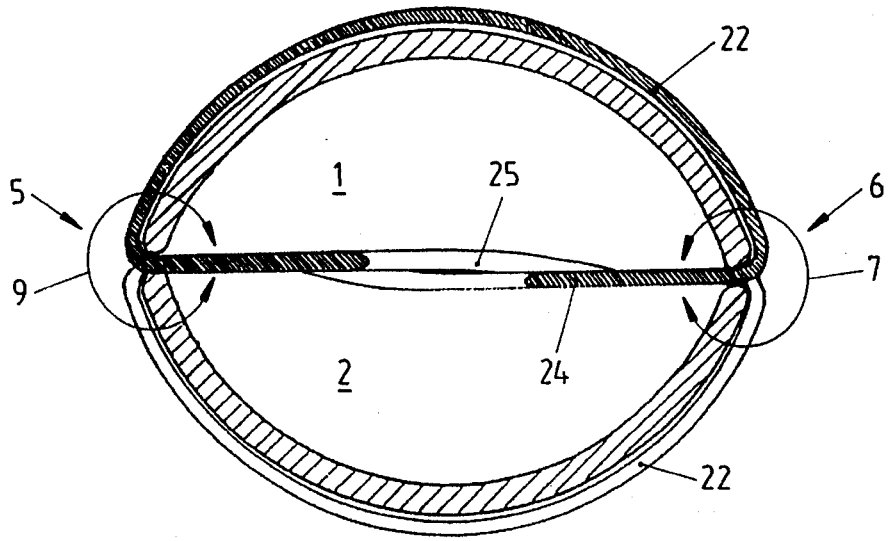

The cross-strapped joints 18, 19, as represented in FIGS. 7*a*, 7*b*, can also be configured in one piece, the criss-cross connection of the joint-strap sections 18, 19, when the container is closed, running within the half-shells In the opposite lateral region of the container there are equally located, as represented according to FIG. 2, two joint straps 13', 14' exhibiting a mirror-image arrangement relative to the symmetrical centreline 17.

The rotary motion of the half-shells 1, 2 in the clockwise direction according to the sequence of motions in FIGS. 3 and 4 is realized analogously, as described in FIG. 1. FIG. 3 herein shows the respective position of the joint strap 13 and FIG. 4 the position of the associated joint strap 14 for the creation of the left cross-strapped joint 18. The right cross-strapped joint 19 in FIG. 2 behaves correspondingly.

In FIGS. 3*a*), *b*) and 4*a*), *b*) respectively, the opening operation of the container is realized by a pivotal motion of the upper half-shell 1 about the fixed hinge axis 7 up to an angle of opening of $\alpha_1=180°$.

If the rotary motion of the upper half-shell 1 is continued in the clockwise direction about the half-shell 2, then the longitudinal axis 7 of the hinge opens from an angle of rotation $\alpha>180°$ and a rolling motion of the arc-shaped contacting surfaces 11, 12 one upon the other takes place, whereupon, as represented according to FIG. 3*c*), the joint strap 13, running diametrically, connects the lower, left abutting edge 5 of the half-shell 1 to the upper, right rear abutting edge 6 of the half-shell 2. Equally, as represented according to FIG. 4*c*), the joint strap 14 assigned to this cross-strapped joint 18 connects the right, lower abutting edge 6 of the here bottommost half-shell 1 to the left, upper abutting edge 5' of the uppermost half-shell 2. In the setting according to FIGS. 3*c*), 4*c*), the joint straps 13, 14 consequently run in an S-shape formation on a respective half of the two arc-shaped contacting surfaces 11, 12. This setting of the container is suitable, for example, for the insertion of a part into the uppermost half-shell 2, the lower half-shell 1 serving as a carrier for the half-shell 2. This can be advantageous to a presentation of the object.

If the half-shell 1, which is bottommost in FIGS. 3*c*), 4*c*), is rotated further in the clockwise direction into an adjacent-lying straight-line position, then the front abutting edge 5 represented in FIGS. 3*a*), 4*a*) becomes a fixed longitudinal axis 9 of the hinge so as to perform the further pivotal motion of the half-shell 1 in the clockwise direction about the half-shell 2, according to the representation in FIGS. 3*d*), 4*d*).

The end position of a once circling pivotal motion is represented in FIGS. 3*e*), 4*e*), it being evident that in this setting the rear abutting edge 6 becomes the new opening edge and the front abutting edge 5 becomes the joint axis or hinge axis 9. The arrangement according to FIGS. 3*a*), 4*a*), upon the pivotal motion of the half-shell 1 about the half-shell 2, therefore opens in the clockwise direction (arrow 20), the arrangement according to FIGS. 3*e*), 4*e*) correspondingly in the counter-clockwise direction (arrow 21). The joint strap 13 travels, in the motional sequence according to FIGS. 3*a*) to 3*e*), from the upper half-shell (FIG. 3*a*)) to the lower half-shell (FIG. 3*e*)). Equally, the joint strap 14 travels, based on the sequence of motions according to FIGS. 4*a*) to 4*e*), from the lower half-shell (FIG. 4*a*)) to the upper half-shell (FIG. 4*e*)). The sequence of motions must therefore be performed by opening the abutting edge 6 in the reverse order, i.e. counter-clockwise.

That pair of joint straps 13', 14' of the cross-strapped joint 19 which is situated on the right side in FIG. 2 behaves, in respect of corresponding sections therethrough, in the same way as in FIGS. 3 and 4. The half-shells 1, 2 are thus fixed tightly together during each and every pivotal motion.

The cross-strapped joints 18, 19 can be situated in the lateral end regions of the half-shells. It is also possible for the joint straps 13, 14 and 13', 14' respectively to be of a real configuration and to extend over the entire width B of the outer contacting surface of the respective half-shell. Thus the two straps 14, 14', for example, can be configured as a one-piece, a real strap which covers the contacting surface of the lower half-shell 2, in the closed state of the container, over a large area. The two lateral joint straps 13, 13' then run laterally from an areal joint strap 14 of this kind, so that virtually the entire contacting surface of an imaginary single half-shell would be covered over. In this arrangement, three joint straps 13, 13' and 14 respectively are sufficient to produce a cross-strapped joint.

The joint straps 13, 14 and 13', 14' respectively can be configured as rubber-like flexible joint straps, which are respectively disposed in the lateral end regions of the container shells and can be respectively configured as a continuous strap (hereto FIGS. 7*a*, 7*b*).

Figure 5A:
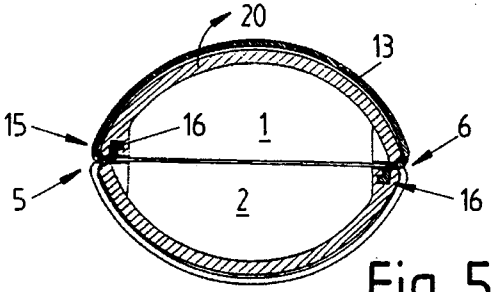
FIGS. 5*a*–5*c* and 6*a*–6*c* show part-regions of the representations according to FIGS. 3 and 4 in enlarged representation.
Figure 5B:
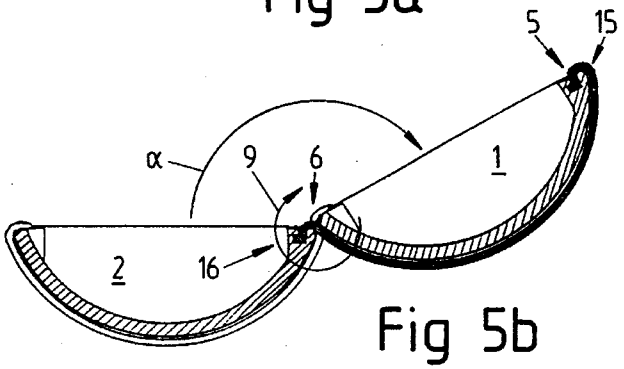
Figure 5C:
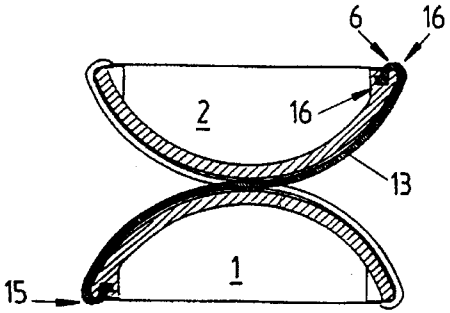
Figure 6A:
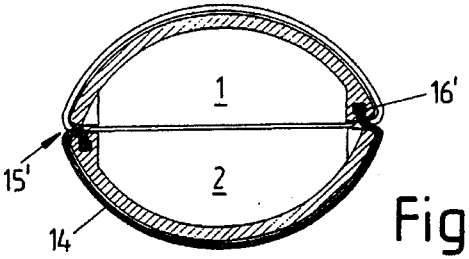
Figure 6C:
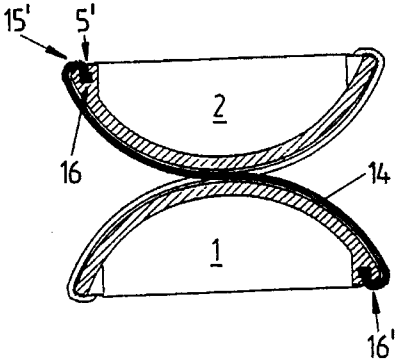

The details shown in FIGS. 5 and 6 represent enlarged views from FIGS. 3, 4. Thus FIG. 5*a*) corresponds to the representation according to FIG. 3a), exhibiting an upper half-shell i and a lower half-shell 2 and a first joint strap 13 which runs round at the top. Equally, FIG. 6*a*) corresponds to the representation according to FIG. 4*a*), exhibiting an upper half-shell 1, a lower half-shell 2 and a lower joint strap 14 which runs round in a semicircle. The container according to FIG. 5*a*) is opened, according to the arrow 20 and the representation according to FIG. 5*b*), in the clockwise direction, thereby enabling an object, e.g. a pair of spectacles, to be inserted into the lower half-shell 2. The rear abutting edge 6 herein forms the fixed swivel hinge 9 up to an angle of opening of $\alpha_1=180°$.

The upper half-shell i can be further pivoted in the clockwise direction, over the angle of opening of 180°, until arriving in a setting as depicted according to FIG. 5*c*). In this setting, the container can be used as a presentation base for the reception of a pair of spectacles into the upper half-shell 2, thereby enabling the spectacles to be displayed, for example, in a shop window.

Figure 6B:
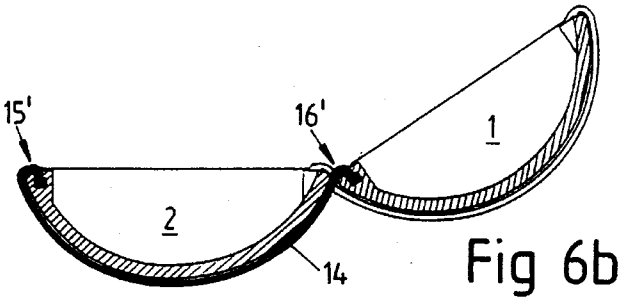

The representation according to FIG. 6*b*) corresponds to the same setting as the representation according to FIG. 5*b*), exhibiting a section through the second joint strap 14. The same applies to the representation of FIGS. 5*c*) and 6*c*), exhibiting a presentation setting of the two half-shells 1, 2.

FIGS. 5*a*) to 5*c*) and 6*a*) to 6*c*) respectively represent the U-shaped fastening or embedment 15, 15' of the respective end of the joint straps 13, 14 in the region of the front abutting edge 5, 5'. At the rear abutting edge 6, the fastening groove 16, 16' is represented, which clamps in place the respective joint strap 13, 14. The fastening points of the respective joint strap 14, 15, which fastening points are respectively diametrically opposed in FIGS. 5*c*), 6*c*), are consequently denoted by reference symbols 15, 16 and 15', 16' respectively.

In FIGS. 7*a*, 7*b*, a design variant of the container configured, for example, as a spectacles case is represented in basic form, exhibiting a continuous joint strap. FIG. 7*a* herein shows an open setting, as corresponds approximately to the representation in FIGS. 1*b*, 3*b*, 4*b* exhibiting the angle of opening α. FIG. 7*b* shows a closed setting of the two half-shells 1, 2, corresponding to the representation in FIGS. 1*a*, 3*a*, 4*a*.

In contrast to the previously described illustrative embodiments according to FIGS. 1 to 6, the illustrative embodiment according to FIG. 7 exhibits two half-shells 1, 2, which are joined together in their lateral end regions by two one-piece cross-strapped joints 18, 19.

Further, as shown in FIGS. 1*a*–1*f*, the half-shells can be held togehter when in a closed position using fastening device 28, which can be, for example, a magnetic or cling fastener attached to the respective abutting edges. The tilted-opensetting of the container shown in FIG. 7*a* represents a section along the sectional plane A in FIG. 2. The continuous strap 22 represented in FIGS. 7*a*, 7*b* runs, in sectional representation, on the arc-shaped contacting surface 11 of the upper half-shell 1 up to the right longitudinal axis 7 of the hinge. In place of a fixed connection of the joint strap in this region to the lower shell 2, the continuous strap 22 is guided via a diagonal strap section 24 to the front longitudinal axis 9 of the hinge, so as from there to enwrap, by means of the arc-shaped contacting surface 12, the lower half-shell 2. The strap which is led back to the right longitudinal axis 7 of the hinge is then guided, via a further diagonal section 25, through the inner wall section of the upper half-shell 1.

That region of the continuous strap 22 which is shaded in FIG. 7*a* is herein located in the sectional plane A in FIG. 2, the non-shaded region of the strap 22 in the sectional plane B of FIG. 2. The transition point 26 from one sectional plane A into the other sectional plane B lies approximately in the middle of the diagonals 24, 25.

In the arrangement according to FIGS. 7*a*, 7*b*, the container can in principle be opened from both sides, the longitudinal axes 7, 9 of the hinge serving as rotational axes. In the representation according to FIG. 7*b*, the container can therefore be opened from both opening edges 5, 6. Such an arrangement additionally enables the two half-shells to roll uninterruptedly one upon the other, without a reversal of direction, as in the illustrative embodiment according to FIG. 1 and FIGS. 3, 4, being necessary.

The continuous cross-strapped joint 19 having a continuous strap 23 (see FIG. 2), which cross-strapped joint is disposed on the other side of the container, is analogously constructed.

The invention is not limited to the described and represented illustrative embodiment. On the contrary, it also embraces all expert refinements and designs within the scope of the inventive concept. More particularly, the half-shells can exhibit optional external shapings, which roll one upon the other with linear or areal contact.

I claim:

1. An openable and closeable container that receives objects, comprising:

first and second mutually-opposing half-shells that are positionable relative to one another to form a hollow body when the container is closed, each half-shell having first and second opposing, longitudinally extending edges, said first edges abutting against each other and said second edges abutting against each other when said half-shells are positioned to form the hollow body; and at least first, second and third joint straps arranged sequentially in the longitudinal direction and extending transverse to the longitudinal direction and in an arcuate path over an outer surface of the respective half-shells to join said half-shells together, said first and second joint straps each having a first end fastened to the first edge of said first half-shell, and a second end fastened to the second edge of said second half-shell, said third joint strap having a first end fastened to the first edge of said second half-shell, and a second end fastened to the second edge of said first half-shell, said joint straps allowing the outer surfaces of said half-shells to roll upon one another when the container is open.

2. The container defined in claim 1, wherein said container is a spectacles case.

3. The container defined in claim 1, wherein said third joint strap is located between said first and second joint straps when said half-shells are in rolling contact.

4. The container defined in claim 3, wherein said joint straps collectively have a total width that is essentially equivalent to a width of the half-shells in the longitudinal direction.

5. The container defined in claim 1, wherein each of the respective edges of said half-shells has at least one fastening groove formed therein for receiving and fastening a respective end of a respective joint strap.

6. The container defined in claim 1, wherein said half-shells have an arcuate cross-sectional profile.

7. The container defined in claim 1, wherein the outer surface of each half-shell comprises at least two individual faces.

8. The container defined in claim 7, wherein the individual faces form at least one of a triangular and parallelogram cross-sectional profile.

9. The container defined in claim 7, wherein the individual faces form facets.

10. The container defined in claim 1, wherein said joint straps are comprised of one of plastic and rubber.

11. An openable and closeable container that receives objects, comprising:

first and second mutually-opposing half-shells that are positionable relative to one another to form a hollow body when the container is closed, each half-shell having first and second opposing, longitudinally extending edges, said first edges abutting against each other and said second edges abutting against each other when said half-shells are positioned to form the hollow body;

at least first and second joint straps arranged sequentially in the longitudinal direction and extending transverse to the longitudinal direction in an arcuate path over an outer surface of the respective half-shells to join said half-shells together, said first joint strap having a first end fastened to the first edge of said first half-shell, and a second end fastened to the second edge of said second half-shell, said second joint strap having a first end fastened to the first edge of said second half-shell, and a second end fastened to the second edge of said first half-shell, said joint straps allowing the outer surfaces of said half-shells to roll upon one another when the container is open; and a fastening device attached to said edges for holding said half-shells together when the container is closed.

12. The container defined in claim 11, wherein said fastening device comprises at least one of a cling fastener and a magnetic fastener.

13. The container defined in claim 11, wherein said first joint strap comprises two first joint straps, each being located on a respective lateral end side region of said half-shells, and said second joint strap comprises two second joint straps, each being located on the respective lateral end side regions of said half-shells and adjacent to the respective first joint straps.

14. The container defined in claim 11, wherein said joint straps collectively have a total width that is essentially equivalent to a width of the half-shells in the longitudinal direction.

15. The container defined in claim 11, wherein each of the respective edges of said half-shells has at least one fastening groove formed therein for receiving and fastening a respective end of a respective joint strap.

16. An openable and closeable container that receives objects, comprising:

first and second mutually-opposing half-shells that are positionable relative to one another to form a hollow body when the container is closed, each half-shell having first and second opposing, longitudinally extending edges, said first edges abutting against each other and said second edges abutting against each other when said half-shells are positioned to form the hollow body;

at least one continuous, one-piece joint strap extending transverse to the longitudinal direction and in an arcuate path from the first edge to the second edge of said first half-shell and over an outer surface of said first half-shell, from the second edge of said first half shell to the first edge of said second half-shell, from the first edge to the second edge of said second half-shell and over an outer surface of said second half-shell, and from the second edge of said second half shell back to the first edge of said first half-shell, respectively, to join said half-shells together, said joint straps allowing the outer surfaces of said half-shells to roll upon one another when the container is open; and a fastening device attached to said edges for holding said half-shells together when the container is closed.

17. The container defined in claim 16, wherein said at least one joint strap comprise two joint straps, each being located on a respective end of said half-shells.

18. The container defined in claim 19, wherein said joint straps collectively have a total width that is essentially equivalent to a width of the half-shells in the longitudinal direction.

19. The container defined in claim 16, wherein said fastening device comprises at least one of a cling fastener and a magnetic fastener.

20. The container defined in claim 16, wherein said half-shells have an arcuate cross-sectional profile.

* * * * *